US011421390B2

(12) United States Patent
Oetken et al.

(10) Patent No.: US 11,421,390 B2
(45) Date of Patent: Aug. 23, 2022

(54) ADJUSTABLE MASS ECCENTRIC FOR MULTI-AMPLITUDE VIBRATORY MECHANISM FOR COMPACTOR AND SYSTEM AND METHOD THEREOF

(71) Applicant: Caterpillar Paving Products Inc., Brooklyn Park, MN (US)

(72) Inventors: Nicholas A. Oetken, Brooklyn Park, MN (US); Todd A. Impola, Minnetonka, MN (US); Timothy M. O'Donnell, Long Lake, MN (US); Shannon G. Dudley, Edina, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 114 days.

(21) Appl. No.: 17/077,474

(22) Filed: Oct. 22, 2020

(65) Prior Publication Data

US 2022/0127797 A1 Apr. 28, 2022

(51) Int. Cl.

| | |
|---|---|
| ***E01C 19/23*** | (2006.01) |
| ***B06B 1/16*** | (2006.01) |
| ***E01C 19/28*** | (2006.01) |
| ***E01C 19/26*** | (2006.01) |

(52) U.S. Cl.

CPC ..... *E01C 19/233* (2013.01); *B06B 1/16* (2013.01); *E01C 19/266* (2013.01); *E01C 19/282* (2013.01); *E01C 19/286* (2013.01)

(58) Field of Classification Search

CPC .... E01C 19/233; E01C 19/266; E01C 19/282; E01C 19/286; B06B 1/16

USPC ..... 404/72, 84.05, 113, 117, 130

See application file for complete search history.

(56) References Cited

U.S. PATENT DOCUMENTS

| | | | | |
|---|---|---|---|---|
| 3,616,730 | A * | 11/1971 | Boone et al. | E01C 19/286 404/117 |
| 3,722,381 | A * | 3/1973 | Tuneblom | E01C 19/286 404/117 |
| 4,586,847 | A * | 5/1986 | Stanton | B02C 19/16 74/61 |
| 4,759,659 | A * | 7/1988 | Copie | E01C 19/286 366/125 |
| 6,551,020 | B2 | 4/2003 | Swanson et al. | |
| 7,775,742 | B2 * | 8/2010 | Buijsman | E02D 3/026 404/130 |

(Continued)

FOREIGN PATENT DOCUMENTS

| | | | |
|---|---|---|---|
| CN | 103495539 | B | 7/2015 |
| CN | 104233931 | B | 1/2017 |
| WO | WO 2018/117048 | A1 | 6/2018 |

*Primary Examiner* — Raymond W Addie

(74) *Attorney, Agent, or Firm* — Oblon, McClelland, Maier & Neustadt

(57) ABSTRACT

An adjustable mass eccentric for a multi-amplitude vibratory mechanism can comprise a body and an internal cavity defined by the body such that the body surrounds the internal cavity. The internal cavity can include a first section, a second section, and a third section between the first section and the second section. The third section can define a volume and/or an area less than respective volumes and/or areas of the first section and the second section of the internal cavity. Filler material may be provided in the internal cavity and can migrate to and from the first, second, and third sections based on rotational movement of the body and internal cavity.

20 Claims, 6 Drawing Sheets

(56) References Cited

U.S. PATENT DOCUMENTS

| | | | | |
|---|---|---|---|---|
| 10,227,737 | B1 * | 3/2019 | Goebel | E02D 3/074 |
| 2017/0016184 | A1 | 1/2017 | Oetken | |

* cited by examiner

ADJUSTABLE MASS ECCENTRIC FOR MULTI-AMPLITUDE VIBRATORY MECHANISM FOR COMPACTOR AND SYSTEM AND METHOD THEREOF

TECHNICAL FIELD

The present disclosure relates to providing vibrations of different amplitudes for a compactor, and more particularly to adjustable mass eccentrics for a multi-amplitude vibratory mechanism for compactors and systems and methods thereof.

BACKGROUND

Conventional vibratory eccentrics may use shot in an internal cavity to change the eccentricity of the eccentric shaft whereby according to a first rotational direction the shot can rotate to add to the eccentricity and according to a second rotational direction the shot can rotate to subtract from the eccentricity. However, such vibratory eccentrics may operate only at two distinct vibration amplitudes when rotated in opposite directions.

On the other hand, patent document CN 103495539 ("the CN '539 patent document") describes an eccentric device comprised of a liquid storage portion located at the center of the eccentric device and eccentric portions located at the two ends of the eccentric device, whereby the liquid storage portion is connected with the eccentric portions through liquid conveying channels having different widths. According to the CN '539 patent document the amplitude of the eccentric device can be automatically adjusted through inertia forces along with changes of the rotation speed. However, the CN '539 patent document may not describe providing distinct vibration amplitudes based on different rotational directions.

SUMMARY OF THE DISCLOSURE

In one aspect, the present disclosure describes an adjustable mass eccentric for a compactor. The adjustable mass eccentric can comprise: a body; an eccentric lobe extending from a side of the body; and an internal cavity defined by the body such that the body completely surrounds the internal cavity. The internal cavity can include a first section, a second section, and a third section between the first section and the second section, the third section defining a volume less than respective volumes of the first section and the second section. The first section and the second section can taper toward the third section, and the eccentric lobe can be arranged closer to the second section than the first section and the third section.

In another aspect, the present disclosure describes a method. The method can comprise: providing a rotatable shaft of a vibratory mechanism of a vibratory roller; and providing an adjustable mass eccentric along the rotatable shaft of the vibratory mechanism of the vibratory roller. The adjustable mass eccentric can include: a body, an internal cavity defined by the body such that the body surrounds the internal cavity, and a filler material provided in the internal cavity. The internal cavity can have a first section, a second section, and a third section between the first section and the second section. The first section can define a first area in a cross-sectional view of the body, the second section can define a second area in the cross-sectional view of the body, and the third section can define a third area in the cross-sectional view of the body, the first and second areas being greater than the third area. The vibratory mechanism can be configured to vibrate the vibratory roller at three or more individual vibration amplitudes based on rotational control of the rotatable shaft and selective placement of the filler material in the first section or in the second section of the internal cavity.

In yet another embodiment, a vibratory compaction machine is described. The vibratory compaction machine can comprise: a chassis; a roller rotatably coupled to the chassis; control circuitry; and a vibratory mechanism including a rotatable shaft and an adjustable mass eccentric provided along the rotatable shaft, the vibratory mechanism being configured to vibrate the roller at three or more individual vibration amplitudes under control of the control circuitry. The adjustable mass eccentric can have a body, an eccentric lobe extending from a first side of the body, the eccentric lobe and the body being formed in one piece, an internal cavity defined by the body such that the body completely surrounds the internal cavity, and a filler material provided in the internal cavity. The internal cavity can have a first section, a second section, and a third section between the first section and the second section, where the third section of the internal cavity may have a portion thereof at a central longitudinal axis of the rotatable shaft. The first section can define a first area in a cross-sectional view of the body, the second section can define a second area in the cross-sectional view of the body, and the third section can define a third area in the cross-sectional view of the body, where the second area may be greater than the first area, and the first area may be greater than the third area. The eccentric lobe can be adjacent to and radially outward of the second section of the internal cavity. The vibratory mechanism can be configured to vibrate the cylindrical roller at the three or more individual vibration amplitudes based on rotational control of the rotatable shaft, under the control of the control circuitry, and position of the filler material within the internal cavity.

Other features and aspects of this disclosure will be apparent from the following description and the accompanying drawings.

DETAILED DESCRIPTION

The present disclosure relates to adjustable mass eccentrics for a multi-amplitude vibratory mechanism for compactors and systems and methods thereof.

Figure 1:
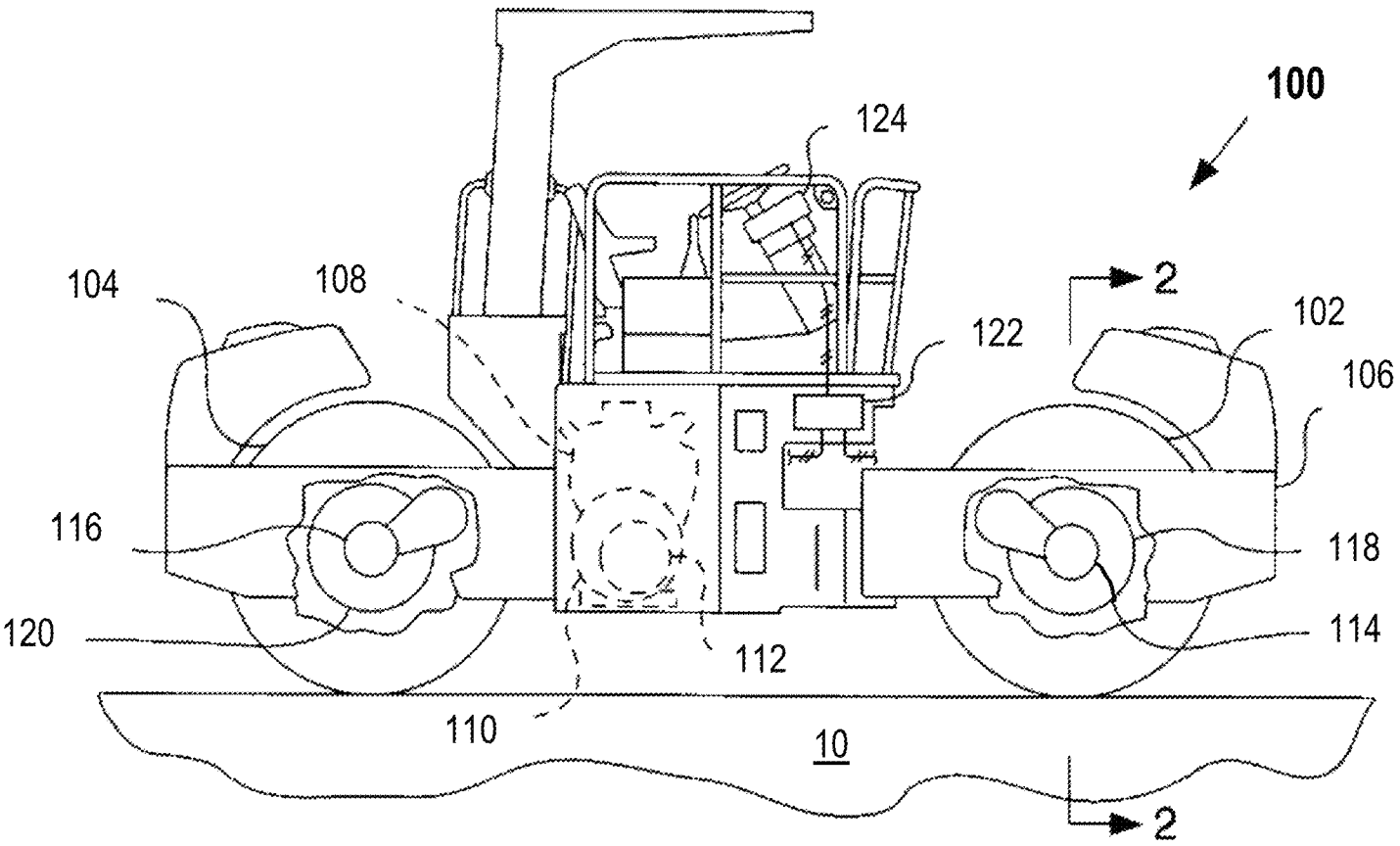
FIG. 1 is a side view of a compactor according to one or more embodiments of the disclosed subject matter.

FIG. 1 is a side view of a vibratory compactor or vibratory compaction machine 100 in accordance with one or more embodiments of the present disclosure. Generally, the vibratory compactor 100 can increase density of an underlying compactable material 10, such as asphalt, soil, or gravel.

The vibratory compactor 100 can include a chassis or frame 106, an engine 108, a first pump 110, a second pump 112, a first motor 114, a second motor 116, and at least one roller, such as a first roller 102 and a second roller 104. The vibratory compactor 100 can also include a controller or control circuitry 122, which may be or include a processor or processing circuitry (including memory), and a user interface 124.

The user interface 124, which may be or include a control panel, can include user or operator inputs, such as switches, touch screens and the like, accessible by the user to operate the vibratory compactor 100. Generally, the user interface 124 can provide user inputs to control the speed and direction of travel (forward or reverse and steering) of the vibratory compactor 100. The user interface 124 can also provide user inputs to control or set an amplitude of vibration for each of the first roller 102 and the second roller 104 from among at least three vibration amplitudes. Inputs at the user interface 124 can be provided to the controller 122 to control operation of various components of the vibratory compactor 100, such as the engine 108, the first pump 110, the second pump 112, the first motor 114, and the second motor 116.

The vibratory compactor 100, according to the example shown in FIG. 1, can include the first roller 102 and the second roller 104, though in an alternative embodiment the vibratory compactor 100 may include only one roller, for instance, first roller 102. In that each roller, such as the first roller 102 and the second roller 104, can increase density of the underlying compactable material 10, rollers according to embodiments of the disclosed subject matter may be referred to as compacting or compaction rollers.

Each of the first roller 102 and the second roller 104 can be rotatably mounted or coupled to the frame 106 such that the first roller 102 and the second roller 104 can rotate clockwise or counterclockwise depending upon controls according to a direction of travel, i.e., forward or reverse, respectively, of the vibratory compactor 100. One or both of first roller 102 and second roller 104 may be cylindrical or in the form of cylinders, though rollers according to embodiments of the disclosed subject matter are not so limited in geometrical configuration. Moreover, a roller, according to embodiments of the disclosed subject matter, may be referred to as a drum.

A vibrating or vibratory mechanism or assembly may be provided for one, some, or all of the rollers. Each such roller may be referred to as a vibratory roller. FIG. 1, for instance, shows a first vibratory mechanism 118 associated with the first roller 102 and a second vibratory mechanism 120 associated with the second roller 104.

The frame 106 can house the engine 108, and the engine 108 can be operatively connected to drive the first pump 110 and the second pump 112, each of which may be fluid (e.g., hydraulic) pumps. The second pump 112 can be operatively connected, by way of conduits, valves, etc., to the first motor 114 and the second motor 116. Hence, the first motor 114 and the second motor 116 may be fluid (e.g., hydraulic) motors. The first pump 110 can be operatively connected, by way of conduits, valves, etc., to respective third motors 117 (see FIG. 2) of the first roller 102 and the second roller 104 to rotate the first roller 102 and the second roller 104.

Figure 2:
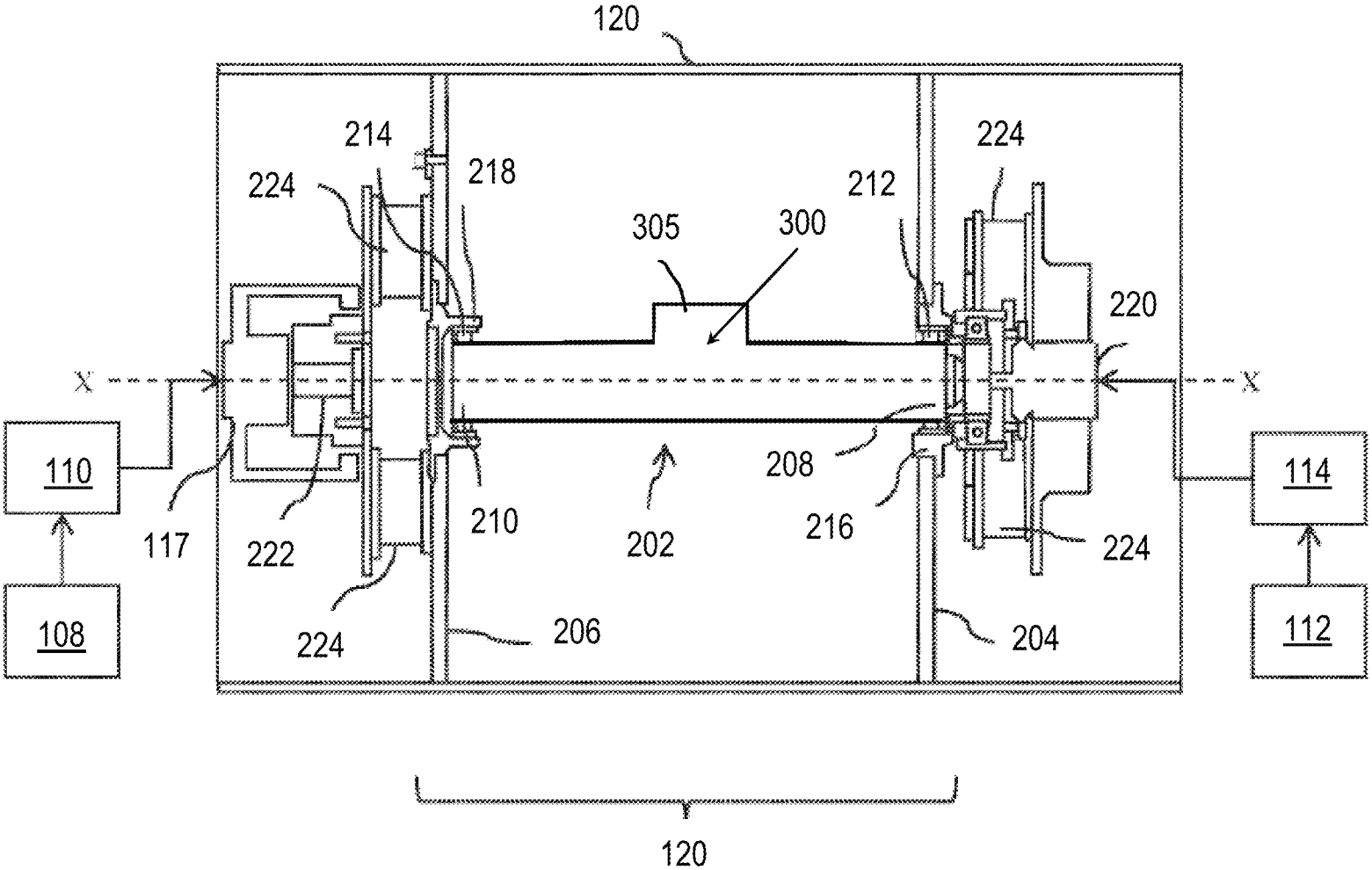
FIG. 2 is a sectional view of a roller of the compactor of FIG. 1.

Referring to FIG. 2, which is a sectional view of the first roller 102 across line 2-2 of FIG. 1, the first roller 102 can include the first vibratory mechanism 118, as noted above. The second roller 104 may be the same as or similar to the first roller 102.

The first vibratory mechanism 118 can include a shaft 202, a first vertical support 204, and a second vertical support 206. The shaft 202, which may be made of a metal or metallic material (e.g., steel or ductile iron), can have a first end portion 208 and a second end portion 210 opposite the first end portion 208. The first end portion 208 and the second end portion 210 can be pivoted relative to and supported by the first vertical support 204 and the second vertical support 206, respectively. Specifically, the first end portion 208 and the second end portion 210 can be positioned within a first bearing 212 and a second bearing 214, respectively. The first bearing 212 and the second bearing 214 can be, in turn, housed inside a first bracket 216 and a second bracket 218, respectively. The first bracket 216 and the second bracket 218 can be attached and supported by the first vertical support 204 and the second vertical support 206, respectively. Hence, the shaft 202 can be supported by the first vertical support 204 and the second vertical support 206, at the first end portion 208 and at the second end portion 210, respectively.

The first end portion 208 of the shaft 202 may also be connected to a first coupling 220. The first coupling 220 may be connected to the first motor 114, such as diagrammatically shown in FIG. 2. Specifically, the first coupling 220 can transfer rotational motion of the first motor 114, in either direction, to the shaft 202 to rotate the shaft 202 in the corresponding direction. To be clear, the shaft 202 may be rotated both clockwise and counterclockwise. The first motor 114, therefore, can control movement of the first vibratory mechanism 118, and hence vibration of the first vibratory mechanism 118. Discussed in more detail below, the controller 122, responsive to an input at the user interface 124, can control the rotational speed and rotational direction of the shaft 202 by way of control of the first motor 114. One or more position sensors, such as encoders, may be provided relative to the shaft 202 to determine rotational position and optionally speed of rotation of the shaft 202 (and corresponding components of the shaft 202).

The third motor 117 may be operatively coupled to the first roller 102 through a second coupling 222. The third motor 117, thus, can be coupled to the first roller 102 so as to rotate the first roller 102 in either direction, clockwise or counterclockwise. The controller 122, responsive to an input at the user interface 124, can control the rotational speed and rotational direction of the first roller 102 by way of control of the third motor 117. Rotation of the first roller 102 (and the second roller 104) can propel the vibratory compactor 100 either forward or backward, depending upon the direction of rotation of the first and second rollers 102, 104. Moreover, operation of the third motor 117 can be independent of operation of the first motor 114 and the second motor 116. Thus, the first roller 102 and the second roller 104 can be controlled to rotate without rotation of the shaft 202 of the first roller 102 and/or the second roller 104. Likewise, the shaft 202 of the first roller 102 and/or the second roller 104 can be controlled to rotate without rotation of the first roller 102 and the second roller 104.

The shaft 202 can include an eccentric weight or mass 300. The eccentric mass 300 can extend or protrude from a side or side portion of the shaft 202. Optionally, the eccentric mass 300 may be formed in one piece or integral with the shaft 202. According to one or more embodiments, the eccentric mass 300 may be centered along a length of the shaft 202, such as shown in FIG. 2. Moreover, the eccentric mass 300 may be spaced from the first end (of the first end portion 208) and the second end (of the second end portion 210) of the shaft 202, such as shown in FIG. 2. Alternatively, the eccentric mass 300 may extend the entire length of the shaft 202. In that the eccentric mass 300 extends from the side or side portion of the shaft 202 the eccentric mass 300 may provide or increase asymmetrical mass for the shaft 202 relative to the line X-X corresponding to the longitudinal axis X of the shaft 202.

The rotation of the asymmetric offset mass provided by the eccentric mass 300 can result in net centrifugal force when the shaft 202 is rotated. That is, rotation of the shaft 202 can generate a centrifugal force based on the eccentric mass 300. At a certain rotational velocity, the shaft 202 of the first vibratory mechanism 118 can attain an operating frequency and start to vibrate due to net centrifugal force. Vibration of the shaft 202 can induce a vibratory force on the first roller 102 through the first vertical support 204 and the second vertical support 206. Hence, rotation of the shaft 202 can induces vibratory forces in the first roller 102. Furthermore, the vibration of the first roller 102 can cause the first roller 102 to compact the compaction material 10. Optionally, damping pads (e.g., rubber pads) 224 may be provided to isolate the first vibrating mechanism 118 from the frame 106.

Discussed in more detail, the characteristics of vibration of the first vibratory mechanism 118, particularly vibration amplitude, can be based on the configuration of the eccentric mass 300. In certain situations, the direction of rotation of the shaft 202 and eccentric mass 300 may also affect the vibration amplitude of the first vibratory mechanism 118. Optionally, the characteristics of the vibration of the first vibratory mechanism 118 can also be based on speed or velocity of rotation of the shaft 202 and eccentric mass 300.

Figure 3:
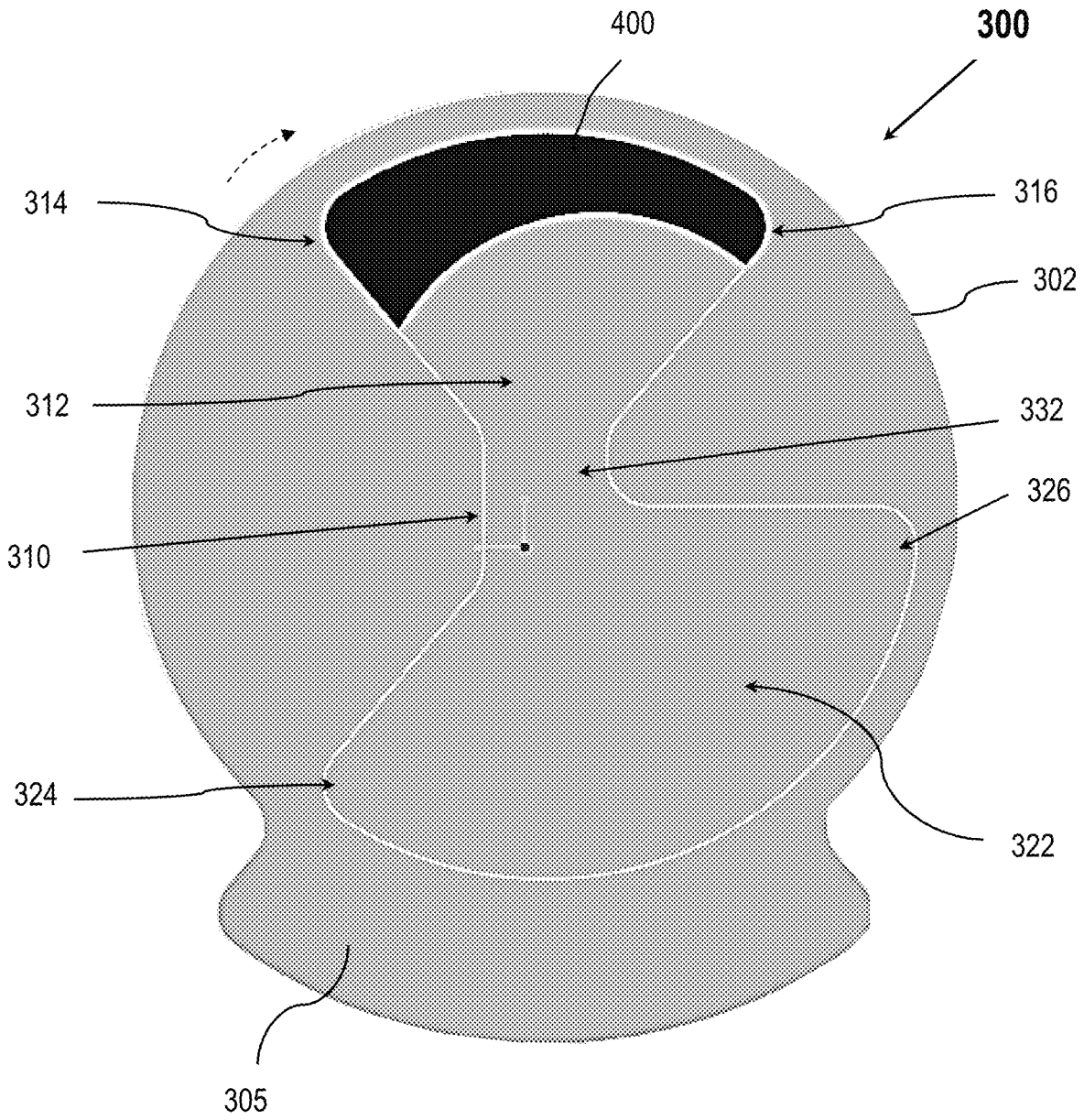
FIG. 3 is a sectional view of an adjustable mass eccentric of a vibratory mechanism adapted to cause vibration according to a first vibration amplitude according to one or more embodiments of the disclosed subject matter.
Figure 4:
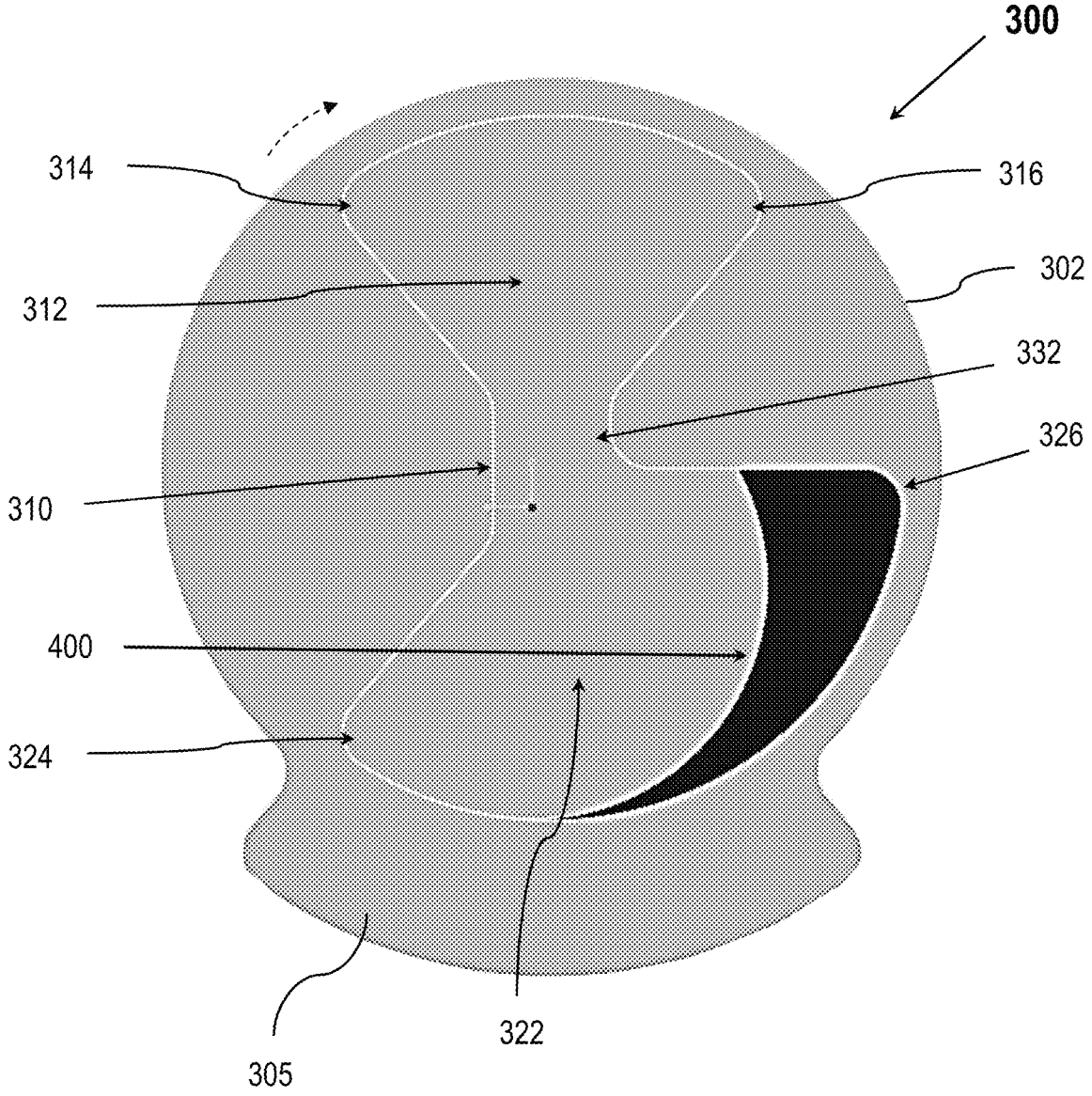
FIG. 4 is a sectional view of the adjustable mass eccentric of FIG. 3 adapted to cause vibration according to a second vibration amplitude according to one or more embodiments of the disclosed subject matter.
Figure 5:
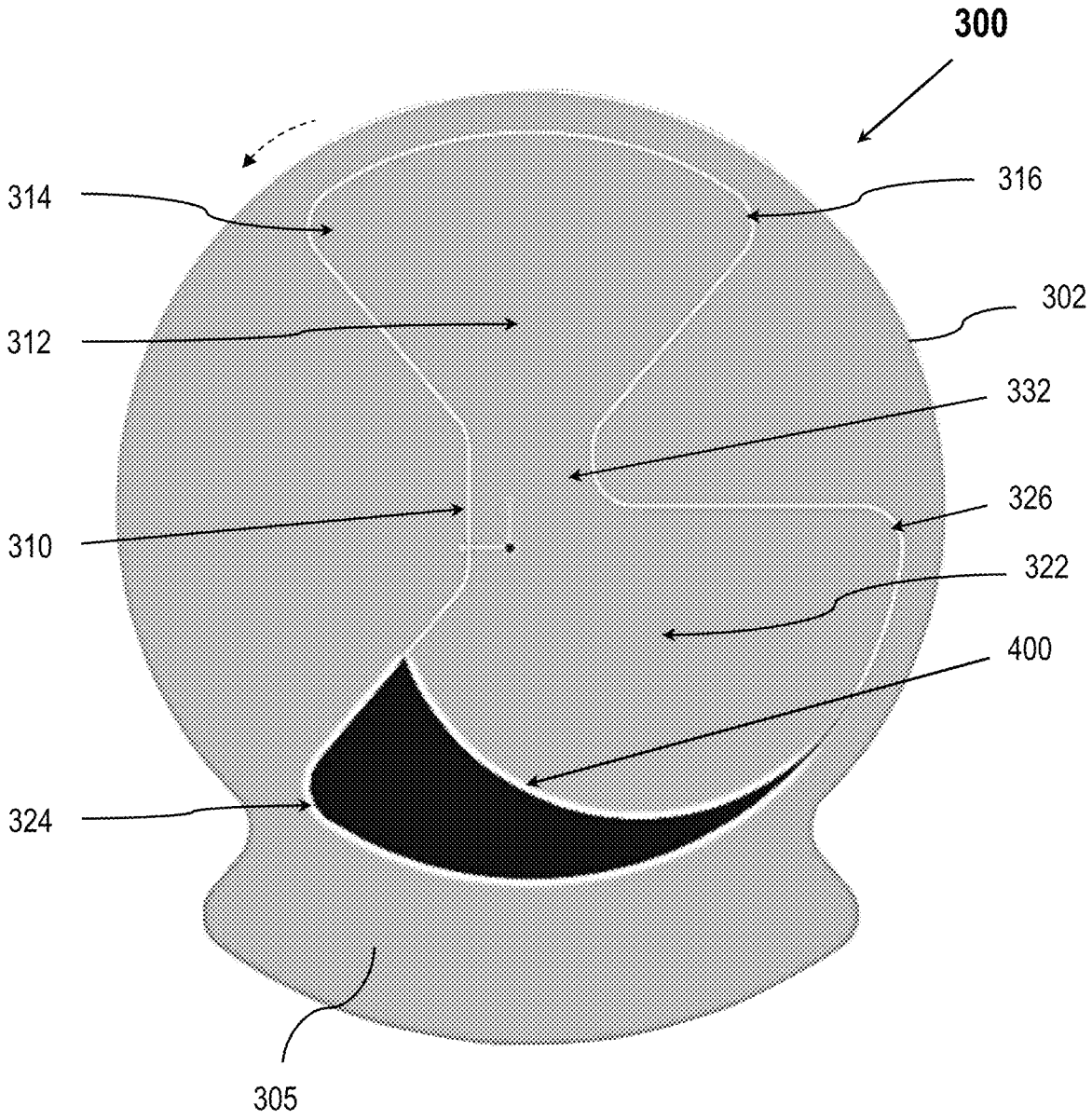
FIG. 5 is a sectional view of the adjustable mass eccentric of FIG. 3 adapted to cause vibration according to a third vibration amplitude according to one or more embodiments of the disclosed subject matter.

FIGS. 3-5 show a sectional view of the eccentric mass 300 in different vibration amplitude configurations according to embodiments of the disclosed subject matter.

The eccentric mass 300 may include a body 302 that defines an internal cavity 310. The body 302 of the eccentric mass 300, which may be solid other than the internal cavity 310 and made of a metal or metallic material (e.g., steel or ductile iron), can define the internal cavity 310 such that the body 302 entirely surrounds the internal cavity 310. The body 302 may be formed in one-piece or as a unit, including optionally as part of the shaft 202. Accordingly, the internal cavity 310 can may be cut or machined out from the body 302 or, alternatively, created using additive manufacturing techniques. Alternatively, according to one or more embodiments, the body 302 may have, include, or otherwise be coupled to opposing end plates that define end walls of the internal cavity 310 in the longitudinal direction along the longitudinal axis X of the shaft 202.

An eccentric lobe 305 may extend from a side or side portion of the body 302. Optionally, the eccentric lobe 305 may be integral to or formed in one piece with the body 302. Thus, the eccentric lobe 305 may be made of the same material (e.g., steel or ductile iron) as the body 302.

The internal cavity 310 can include a first section 312, a second section 322, and a third section 332. As shown in FIGS. 3-5, the third section 332 can be between the first section 312 and the second section 322. Optionally, the third section 332 may have a portion thereof at the longitudinal axis X of the shaft 202. According to one or more embodiments, the internal cavity 310 may consist of only three sections, such as the first section 312, the second section 322, and the third section 332. That is, the internal cavity 310 may have only three sections according to one or more embodiments. Alternatively, embodiments of the disclosed subject matter may include more than three sections, for instance, and may include another section in communication with the third section 332 or, alternatively, not in communication with any of the first section 312, the second section 322, and the third section 332. Such section may be provided to provide one or two additional vibration amplitudes for the first vibratory mechanism 118.

Filler material 400 may be provided in the internal cavity 310. The filler material 400 may be metal or metallic members, such as shot, steel balls, metal slugs, liquid metal, or sand, or some other liquid such as water, that can move or flow between the first section 312, the second section 322, and the third section 332. Discussed in more detail below, the filler material 400 may be movable in a controlled fashion between the first section 312, the second section 322, and the third section 332 based on rotation of the internal cavity 310 in correspondence with rotation of the shaft 202 (and the body 302).

In one or more cross-sectional views the internal cavity 310 can take the shape of or generally the shape of an hour glass, such as shown in FIGS. 3-5. Thus, the first section 312 and/or the second section 322 may taper or converge toward and optionally to the third section 332.

As shown in FIGS. 3-5, for instance, the first section 312, the second section 322, and the third section 332 can have difference sizes and shapes. For instance, the first section 312 may define a first area in a cross-sectional view, the second section 322 may define a second area in the cross-sectional view, and the third section 332 may define a third area in the cross-sectional view of the body. The second area can be greater than the first area, and the first area can be greater than the third area. Additionally or alternatively, the first section 312 may define a first volume, the second section 322 may define a second volume, and the third section 332 may define a third volume, where the second volume is greater than the first volume and the first volume is greater than the third volume. Alternatively, the first section 312 and the second section 322 may have cross-sectional areas and/or volumes that are the same or substantially the same.

The first section 312 and/or the second section 322 may be asymmetrical or symmetrical in the cross-sectional view of the eccentric mass 300. For instance, FIGS. 3-5 show the first section 312 being symmetrical, whereas the second section 322 is asymmetrical. Optionally, the first section 312 and the second section 322 may have respective first and second curved outer radial walls. As shown in FIGS. 3-5, the first curved outer radial wall of the first section 312 may have a first arc with a length less than a second arc of the second curved outer radial wall of the second section 322.

Each of the first section 312 and the second section 322 can have one or two catchments adapted to catch and retain the filler material 400 when the eccentric mass 300 is rotated in a particular direction and the filler material 400 is in the corresponding first section 312 or the second section 322. For instance, first section 312 can have a first filler material catchment 314 and a second filler material catchment 316. Likewise, the second section 322 can have a first filler material catchment 324 and a second filler material catchment 326.

As shown in FIGS. 3-5 the first filler material catchment 314 and the second filler material catchment 316 of the first section 312 can be at opposing corners, for instance, outer radial corners, of the first section 312. Similarly, the first filler material catchment 324 and the second filler material catchment 326 of the second section 322 can be at opposing corners, for instance, outer radial corners, of the second section 322. The first and second filler material catchments 314, 316 of the first section 312 may be referred to herein as a first pair or set of filler material catchments, and the first and second filler material catchments 324, 326 of the second section 322 may be referred to herein as a second pair or set of filler material catchments.

The eccentric lobe 305 may be positioned relative to the first section 312 and the second section 322. According to one or more embodiments, the eccentric lobe 305 can be provided on a side of the body 302 associated with the second section 322 of the internal cavity 310. For instance, the eccentric lobe 305 may be positioned closer to the second section 322 of the internal cavity 310 than the third section 332 and the first section 312. Though FIGS. 3-5 show the eccentric lobe 305 being on a side of the body 302 closer to the second section 322, in this embodiment the section having the largest cross sectional area of the three sections, alternatively the eccentric lobe 305 may be on a side of the body 302 closer to the first section 312, which in this embodiment has a cross sectional area less than the cross sectional area of the second section 322.

Optionally, the eccentric lobe 305 may be arranged adjacent to and radially outward of the second section 322, such as shown in FIGS. 3-5. In this regard, the eccentric lobe 305 may partially overlap or cover the second curved outer radial wall of the second section 322, such as shown in FIGS. 3-5. In this regard, the first filler material catchment 324 of the second section 322 may be adjacent to, overlap, and/or be aligned with the eccentric lobe 305, whereas the second filler material catchment 326 of the second section 322 may not be adjacent to, overlapped with, and/or aligned with the eccentric lobe 305. Alternatively, the eccentric lobe 305 may fully overlap or cover the second curved outer radial wall of the second section 322. The first section 312 of the internal cavity 310 may be characterized as not being adjacent to, overlapping, and/or aligned with the eccentric lobe 305.

The first vibratory mechanism 118 can be configured to vibrate the first roller 102 at three or more individual vibration amplitudes based on at least the placement of the filler material 400 and the direction of rotation of the internal cavity 310 (along with the body 302 and shaft 202). Thus, the eccentric mass 300 may be characterized as an adjustable weight or eccentric.

Each section of the internal cavity 310, except the third section 332 or a similar filler material "transfer" section, may be associated with one or two different vibration amplitudes, depending upon the configuration (i.e., area, geometry, volume, etc.) of the particular section. For instance, referring to the eccentric mass 300 of FIGS. 3-5, the first section 312 may be associated with a first vibration amplitude and the second section 322 may be associated with a second vibration amplitude and a third vibration amplitude. Moreover, in that the first section 312 can be symmetrical, the first section 312 may be associated with only one vibration amplitude. In that the second section 322 is positioned closer to the eccentric lobe 305, the second and third vibration amplitudes can be greater than the first vibration amplitude associated with the first section 312.

More specifically regarding FIGS. 3-5, FIG. 3 can correspond to an example of the first vibration amplitude, FIG. 4 can correspond to an example of the second vibration amplitude, and FIG. 5 can correspond to an example of the third vibration amplitude, where the second vibration amplitude is greater than the first vibration amplitude and the third vibration amplitude is greater than the second vibration amplitude.

In FIG. 3, to produce the first vibration amplitude, the filler material 400 can be provided in the first section 312 and then the internal cavity 310 be rotated clockwise. The filler material 400 can be forced toward the first filler material catchment 314, particularly the corner between the curved outer radial wall of the first section 312 and a trailing (according to rotation direction) inward extending sidewall forming the first filler material catchment 314, such as shown in FIG. 3. Based on the positioning of the filler material 400 relative to the eccentric lobe 305, i.e., opposite the eccentric lobe 305, and the rotation of the internal cavity 310 (and the shaft 202 and the body 302), the eccentric mass 300 can vibrate at the first vibration amplitude. Since the first section 312, in the cross sectional view, is symmetrical, though the above description specifies clockwise rotation the first vibration amplitude can be likewise provided by counterclockwise rotation.

In FIG. 4, to produce the second vibration amplitude, the filler material 400 can be provided in the second section 322 and then the internal cavity 310 be rotated clockwise. The filler material 400 can be forced toward the second filler material catchment 326 of the second section 322, particularly the corner between the curved outer radial wall of the second section 322 and a trailing (according to rotation direction) inward extending sidewall forming the second filler material catchment 326, such as shown in FIG. 4. Because the filler material 400 is offset from the eccentric lobe 305 the rotation of the internal cavity 310 (and the shaft 202 and the body 302) can cause the eccentric mass 300 to vibrate at the second vibration amplitude.

In FIG. 5, to produce the third vibration amplitude, i.e., the highest vibration amplitude of the available vibration amplitudes of the eccentric mass 300, the filler material 400 can be provided in the second section 322 and then the internal cavity 310 be rotated counterclockwise. The filler material 400 can be forced toward the first filler material catchment 324 of the second section 322, particularly the corner between the curved outer radial wall of the second section 322 and a trailing (according to rotation direction) inward extending sidewall forming the first filler material catchment 324, such as shown in FIG. 5. Because the filler material 400 is in alignment with the eccentric lobe 305 the rotation of the internal cavity 310 (and the shaft 202 and the body 302) can cause the eccentric mass 300 to vibrate at the third vibration amplitude.

INDUSTRIAL APPLICABILITY

As noted above, the present disclosure relates to adjustable mass eccentrics for a multi-amplitude vibratory mechanism for compactors and systems and methods thereof.

Embodiments of the disclosed subject matter can involve an eccentric weight or mass, such as eccentric mass 300, that has an internal cavity with two or more vibration amplitude-affecting sections, where each of the vibration amplitude-affecting sections can provide for one or two different vibration amplitudes based on direction of rotation for a corresponding shaft, such as shaft 202. Thus, embodiments of the disclosed subject matter can provide three or more (e.g., three to six) individually selectable vibration amplitudes at which they operate a vibratory roller, such as first roller 102 and/or second roller 104. The filler material, such as filler material 400, can flow or otherwise be transferred to and from different sections, gravitationally, and within a particular section via rotation direction, to a position in the internal cavity 310 to provide one of three or more distinct vibration amplitudes for the shaft 202 during operational rotation speeds. The individual vibration amplitudes can be selected via user input at a user interface, for instance, a user interface of the compaction machine 100, such as user interface 124.

Figure 6:
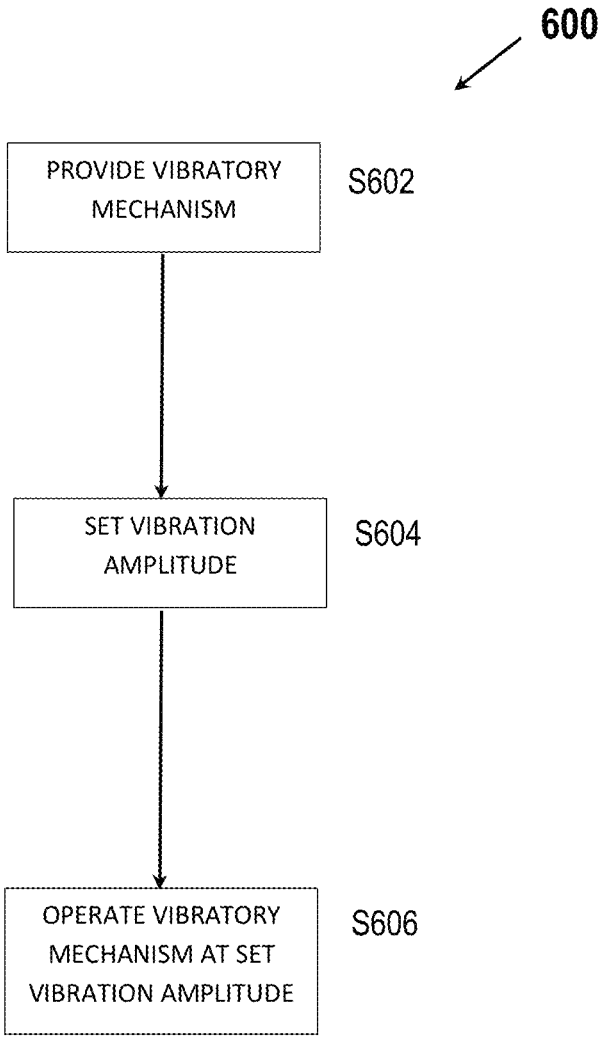
FIG. 6 is a flow chart of a method according to one or more embodiments of the disclosed subject matter.

Turning to FIG. 6, FIG. 6 is a flow chart for a method 600 according to one or more embodiments of the disclosed subject matter.

The method 600 can be implemented relative to or by machines according to embodiments of the disclosed subject matter, such as the vibratory compactor 100. Control portions of the method 600 can be implemented using a non-transitory computer-readable storage medium storing computer-readable instructions that, when executed by one or more computers, such as controller 122, cause the one or more computers to perform the method 600, or portions thereof as the case may be.

At S602 the method 600 can include providing a vibratory mechanism, such as first vibratory mechanism 118, or portion thereof, such as shaft 202, which can include an adjustable weight or mass eccentric, such as eccentric mass 300. The vibratory mechanism can be provided in the contact of a roller, such as first roller 102 and/or second roller 104, in a vibratory compactor, such as vibratory compactor 100.

At S604 the method 600 can include setting a vibration amplitude from among at least three vibration amplitudes at which to operate the first roller 102 and/or the second roller 104. The setting may be performed responsive to a user input at the user interface 124, for instance, which can provide a corresponding signal or signals to the controller 122 for the control of components necessary to operate the shaft 202 at the desired vibration amplitude, such as the second pump 112, the first motor 114, and the second motor 116 in the case of also operating the second roller 104 at the desired vibration amplitude. Alternatively, the control input may be received from a controller offboard the vibratory compactor 100, or responsive to sensors or programmed commands regarding operation in the case of an autonomous vibratory compactor 100. Optionally, in the case of first vibration mechanism 118 and second vibration mechanism 120 the respective set vibration amplitudes may be the same or different. The setting at S604 may be performed when the vibratory compactor 100 is stopped or moving forward or backward.

The shaft 202 may need to be controlled to configure the eccentric mass 300 to provide the desired vibration amplitude depending upon the state of the shaft 202 (e.g., rotating or not, rotational speed, rotational direction, orientation of the internal cavity 310) and the current position of the filler material 400 in the internal cavity 310 when the command is received to set the vibration amplitude. Position information regarding filler material 400 may be stored in memory of the controller 122, or the controller 12 may otherwise know the position of the filler material 400 based on a current vibration amplitude at which the shaft 202 is operating or a recorded current orientation of the internal cavity 310 from an immediately prior operation in a case when the shaft 202 is not currently rotating. As noted above, one or more position sensors, such as encoders, may be provided to control positioning of the shaft 202 and optionally determine rotational speed of the shaft 202.

In some cases the setting of the vibration amplitude may include stopping the shaft 202 (and hence the eccentric mass 300) such that a corresponding section of the internal cavity 310, such as first section 312 or second section 322, associated with the selected vibration amplitude is positioned so the filler material 400 is gravitationally caused to flow or otherwise travel to the corresponding lower vibration amplitude-related section (e.g., to the first section 312) of the internal cavity 310 from the upper vibration amplitude-related section (e.g., from the second section 322). As noted earlier, the filler material 400 may travel through the third section 332 to reach the corresponding vibration amplitude-related section of the internal cavity 310. For example, transitioning from the vibration amplitude associated with FIG. 3 to the vibration amplitude associated with FIG. 4, i.e., the set vibration amplitude, the shaft 202 can be controlled to stop such that the internal cavity 310 is oriented as shown in FIG. 3.

The shaft 202 can be stopped for a predetermined amount of time (e.g., 2 seconds) to allow the filler material 400 to flow from the first section 312 to the second section 322 via the third section 332. Likewise, to transfer the filler material 400, under the force of gravity, from the second section 322 to the first section 312 the internal cavity 310 can be stopped in a position 180 degrees from the position shown in FIG. 3. The transfer of filler material 400 can be such that no filler material 400 remains in the upper vibration amplitude-related section. The amount of time can be set based on an assumption of how much time is needed to fully transfer the particular type of filler material 400 between the particularly configured sections of the internal cavity 310.

In the case that the filler material 400 is already in the second section 322 of the internal cavity 310, the vibration amplitude can be set based on rotational direction of the shaft 202 (and hence the eccentric mass 300) to provide different distinct vibration amplitudes associated with the second section 322 of the internal cavity 310, which leads to the discussion of operating the vibratory mechanism at S606.

At S606 the vibratory mechanism, such as first vibratory mechanism 118, can be operated to vibrate the first roller 102 at the vibration amplitude associated with the set vibration amplitude according to S604. Such operation of the first vibratory mechanism 118 can include rotating the shaft 202 (and hence the eccentric mass 300) at sufficient rotational speed such that the filler material 400 stays in the vibration amplitude-related section of the internal cavity 310 (e.g., either first section 312 or second section 322). As noted above, the vibratory mechanism 118 may be operated to vibrate the first roller 102 when the vibratory compactor 100 is stopped or moving forward or backward.

As an example, as noted above, regarding FIGS. 3-5, FIG. 3 can correspond to an example of the first vibration amplitude, FIG. 4 can correspond to an example of the second vibration amplitude, and FIG. 5 can correspond to an example of the third vibration amplitude, where the second vibration amplitude is greater than the first vibration amplitude and the third vibration amplitude is greater than the second vibration amplitude.

In FIG. 3, to produce the first vibration amplitude, the filler material 400 can be provided in the first section 312 and then the internal cavity 310 be rotated clockwise. The filler material 400 can be forced toward the first filler material catchment 314, particularly the corner between the curved outer radial wall of the first section 312 and a trailing (according to rotation direction) inward extending sidewall forming the first filler material catchment 314, such as shown in FIG. 3. Based on the positioning of the filler material 400 relative to the eccentric lobe 305, i.e., opposite the eccentric lobe 305, and the rotation of the internal cavity 310 (and the shaft 202 and the body 302), the eccentric mass 300 can vibrate at the first vibration amplitude. Since the first section 312, in the cross-sectional view, is symmetrical, though the above description specifies clockwise rotation the first vibration amplitude can be likewise provided by counterclockwise rotation.

In FIG. 4, to produce the second vibration amplitude, the filler material 400 can be provided in the second section 322 and then the internal cavity 310 be rotated clockwise. The filler material 400 can be forced toward the second filler material catchment 326 of the second section 322, particularly the corner between the curved outer radial wall of the second section 322 and a trailing (according to rotation direction) inward extending sidewall forming the second filler material catchment 326, such as shown in FIG. 4. Because the filler material 400 is offset from the eccentric lobe 305 the rotation of the internal cavity 310 (and the shaft 202 and the body 302) can cause the eccentric mass 300 to vibrate at the second vibration amplitude.

In FIG. 5, to produce the third vibration amplitude, i.e., the highest vibration amplitude of the available vibration amplitudes of the eccentric mass 300, the filler material 400 can be provided in the second section 322 and then the internal cavity 310 be rotated counterclockwise. The filler material 400 can be forced toward the first filler material catchment 324 of the second section 322, particularly the corner between the curved outer radial wall of the second section 322 and a trailing (according to rotation direction) inward extending sidewall forming the first filler material catchment 324, such as shown in FIG. 5. Because the filler material 400 is in alignment with the eccentric lobe 305 the rotation of the internal cavity 310 (and the shaft 202 and the body 302) can cause the eccentric mass 300 to vibrate at the third vibration amplitude.

According to one or more embodiments, the rotational speed of the shaft 202 (and hence the eccentric mass 300) may be the same for all of the distinct vibration amplitudes. Alternatively, the rotational speed may be inversely proportional to the vibration amplitude. For instance, the vibration amplitude associated with FIG. 3 can be associated with rotation at a first rotational speed, the vibration amplitude associated with FIG. 4 can be at a second rotational speed, and the vibration amplitude associated with FIG. 5 can be at a third rotational speed, where the second rotational speed is greater than the third rotational speed and the first rotational speed is greater than the second rotational speed. As an example, the shaft 202 may be rotated at rotational speeds from 1,400 rpm to 3,800 rpm (e.g., where a soil compactor may be associated with the lower portion of the range and an asphalt compactor may be associated with the upper portion of the range). For instance, the vibration amplitude associated with FIG. 3 may be 3,800 rpm, the vibration amplitude associated with FIG. 4 may be 3,200 rpm, and the vibration amplitude associated with FIG. 5 may be 2,500 rpm.

The different vibration amplitudes associated with the different vibration amplitude-related section of the internal cavity 310 (e.g., first section 312 and second section 322) may vary according to rotational speed of the shaft 202. Accordingly, each vibration amplitude-related section of the internal cavity 310 may be associated with one or two distinct and non-overlapping vibration amplitude ranges.

Operation S606 may return to S604 to set (i.e., set again) the vibration amplitude of the first vibratory mechanism 118 to another distinct vibration amplitude. Otherwise, the vibratory mechanism 118 may be turned off, for instance, via an input at the user interface 124 (e.g., even though the vibratory compactor 100 is still moving). Turning off the first vibratory mechanism 118 may cause shaft to stop rotating so the internal cavity 310 is positioned such that the filler material 400 is in the same vibration amplitude-related section (e.g., first section 312 or second section 322) associated with the most recent vibration amplitude at which the first vibratory mechanism 118 was operated. Thus, the first vibratory mechanism 118 may be more easily started at the same vibration amplitude should such vibration amplitude next be set for operation of the first vibratory mechanism 118.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A vibratory compaction machine comprising:
a chassis;
a roller rotatably coupled to the chassis;
control circuitry; and
a vibratory mechanism including a rotatable shaft and an adjustable mass eccentric provided along the rotatable shaft, the vibratory mechanism being configured to vibrate the roller at three or more individual vibration amplitudes under control of the control circuitry, and the adjustable mass eccentric having:
a body,
an eccentric lobe extending from a first side of the body, the eccentric lobe and the body being formed in one piece,
an internal cavity defined by the body such that the body completely surrounds the internal cavity, and
a filler material provided in the internal cavity,
wherein the internal cavity has a first section, a second section, and a third section between the first section and the second section, the third section of the internal cavity having a portion thereof at a central longitudinal axis of the rotatable shaft,
wherein the first section defines a first area in a cross-sectional view of the body, the second section defines a second area in the cross-sectional view of the body, and the third section defines a third area in the cross-sectional view of the body, the second area being greater than the first area, and the first area being greater than the third area,
wherein the eccentric lobe is adjacent to and radially outward of the second section of the internal cavity, and
wherein the vibratory mechanism is configured to vibrate the cylindrical roller at the three or more individual vibration amplitudes based on rotational control of the rotatable shaft, under the control of the control circuitry, and position of the filler material within the internal cavity.

2. The vibratory compaction machine according to claim 1, wherein the internal cavity has a shape of an hour glass in the cross-sectional view of the body.

3. The vibratory compaction machine according to claim 1, wherein the filler material is metal shot.

4. The vibratory compaction machine according to claim 1, wherein the first section and the second section of the internal cavity converge to the third section of the internal cavity.

5. The vibratory compaction machine according to claim 1, wherein the first section of the internal cavity is associated with a first vibration amplitude of the three or more individual vibration amplitudes, wherein the second section of the internal cavity is associated with a second vibration amplitude and a third vibration amplitude of the three or more individual vibration amplitudes, and wherein the second and third vibration amplitudes are greater than the first vibration amplitude.

6. The vibratory compaction machine according to claim 1, wherein the first section of the internal cavity defines a first set of two opposing filler material catchments and the second section of the internal cavity defines a second set of two opposing filler material catchments.

7. The vibratory compaction machine according to claim 6, wherein a first filler material catchment of the second set of two opposing filler material catchments of the second section is aligned with the eccentric lobe and a second filler material catchment of the second set of two opposing filler material catchments of the second section is offset from the eccentric lobe.

8. A method comprising:

providing a rotatable shaft of a vibratory mechanism of a vibratory roller; and providing an adjustable mass eccentric along the rotatable shaft of the vibratory mechanism of the vibratory roller, wherein the adjustable mass eccentric includes:

a body, an internal cavity defined by the body such that the body surrounds the internal cavity, and a filler material provided in the internal cavity, wherein the internal cavity has a first section, a second section, and a third section between the first section and the second section, wherein the first section defines a first area in a cross-sectional view of the body, the second section defines a second area in the cross-sectional view of the body, and the third section defines a third area in the cross-sectional view of the body, the first and second areas being greater than the third area, and wherein the vibratory mechanism is configured to vibrate the vibratory roller at three or more individual vibration amplitudes based on rotational control of the rotatable shaft and selective placement of the filler material in the first section or in the second section of the internal cavity.

9. The method according to claim 8, wherein the three or more vibration amplitudes include at least a first vibration amplitude associated with the first section of the internal cavity, a second vibration amplitude associated with the second section of the internal cavity, and a third vibration amplitude associated with the second section of the internal cavity, and wherein the second vibration amplitude is greater than the first vibration amplitude, and the third vibration amplitude is greater than the second vibration amplitude.

10. The method according to claim 8, further comprising operating the vibratory mechanism at one of the three or more vibration amplitudes responsive to an input command at a user interface, wherein the adjustable mass eccentric further includes an eccentric lobe provided on a side of the body associated with the second section of the internal cavity.

11. The method according to claim 8, further comprising:

controlling, using a controller, the rotatable shaft to position the body and the internal cavity of the adjustable mass eccentric such that the filler material is in the first section of the internal cavity to provide a first vibration amplitude responsive to a first control input selecting the first vibration amplitude;

controlling, using the controller, the rotatable shaft to position the body and the internal cavity of the adjustable mass eccentric such that the filler material is in a first filler material catchment of the second section of the internal cavity to provide a second vibration amplitude responsive to a second control input selecting the second vibration amplitude; and controlling, using the controller, the rotatable shaft to position the body and the internal cavity of the adjustable mass eccentric such that the filler material is in a second filler material catchment of the second section of the internal cavity to provide a third vibration amplitude responsive to a third control input selecting the third vibration amplitude.

12. The method according to claim 8, further comprising setting, using a controller, the vibratory mechanism to operate at one of the three or more vibration amplitudes by positioning the internal cavity of the adjustable mass eccentric such that the filler material is gravitationally transferred from the first section to the second section or vice versa by way of the third section and such that no filler material remains in the third section.

13. The method according to claim 8, further comprising changing vibration amplitude of the vibratory mechanism, using a controller, by changing rotational direction of the body and the internal cavity when the filler material is in the second section of the internal cavity.

14. The method according to claim 8, further comprising operating, using the controller, the vibratory mechanism at a first vibration amplitude of the three or more vibration amplitudes when the filler material is in the first section of the internal cavity and the body and the internal cavity are rotating in either of a first rotational direction or a second rotational direction opposite the first rotational direction.

15. An adjustable mass eccentric for a compactor comprising:

a body;

an eccentric lobe extending from a side of the body; and an internal cavity defined by the body such that the body completely surrounds the internal cavity, wherein the internal cavity includes:

a first section, a second section, and a third section between the first section and the second section, the third section defining a volume less than respective volumes of the first section and the second section, wherein the first section and the second section taper toward the third section, and wherein the eccentric lobe is arranged closer to the second section than the first section and the third section.

16. The adjustable mass eccentric according to claim 15, further comprising:

metal filler material enclosed in the internal cavity; and a shaft having a first end and a second end opposite the first end, the body being provided along the shaft spaced from the first and second ends of the shaft, wherein the metal filler material is movable between the first, second, and third sections based on rotation of the internal cavity in correspondence with rotation of the shaft.

17. The adjustable mass eccentric according to claim 15, wherein in a side cross-sectional view the first section has a first curved outer radial wall and the second section has a second curved outer radial wall, and wherein a first arc of the first curved outer radial wall is shorter in length than a second arc of the second curved outer radial wall.

18. The adjustable mass eccentric according to claim 15, wherein the body, the eccentric lobe, and the internal cavity are configured to rotate in unison on a shaft to vibrate a vibration mechanism of the compactor at individual vibration amplitudes in three or more distinct and non-overlapping vibration amplitude ranges.

19. The adjustable mass eccentric according to claim 15, wherein the first section defines filler material catchments at opposing corners thereof, and wherein the second section defines filler material catchments at opposing corners thereof.

20. The adjustable mass eccentric according to claim 19, wherein a first one of the filler material catchments of the second section overlaps and is adjacent to the eccentric lobe, and wherein a second one of the filler material catchments of the second section does not overlap and is not adjacent to the eccentric lobe.

* * * * *